United States Patent [19]

Ikeno et al.

[11] 4,269,904

[45] May 26, 1981

[54] MANGANESE SURFACE COATED STEEL MATERIALS

[75] Inventors: Teruo Ikeno, Mitaka; Satoshi Kado, Fujisawa; Saburo Ayusawa, Funabashi; Hironobu Kawasaki, Machida; Takashi Watanabe, Ayase, all of Japan

[73] Assignee: Nippon Steel Corporation, Tokyo, Japan

[21] Appl. No.: 44,486

[22] Filed: Jun. 1, 1979

[30] Foreign Application Priority Data

| | | | |
|---|---|---|---|
| Jun. 5, 1978 | [JP] | Japan | 53-67467 |
| Jul. 20, 1978 | [JP] | Japan | 53-88639 |
| Oct. 31, 1978 | [JP] | Japan | 53-134038 |
| Nov. 2, 1978 | [JP] | Japan | 53-135423 |

[51] Int. Cl.[3] ..... B32B 15/08; B32B 15/18

[52] U.S. Cl. ..... 428/623; 428/624; 428/626; 428/629; 428/655; 428/684; 428/926

[58] Field of Search ..... 148/31.5; 428/623–626, 428/628, 629, 632, 633, 658, 659, 655, 656, 926, 935, 684, 685; 204/40, 45.5, 57, 96

[56] References Cited

U.S. PATENT DOCUMENTS

| | | | |
|---|---|---|---|
| Re. 26,223 | 6/1967 | Smith et al. | 428/655 |
| 2,636,257 | 4/1953 | Ford | 428/628 |
| 2,637,896 | 5/1953 | Nachtman | 428/658 |
| 2,812,298 | 11/1957 | Hardoen | 204/96 |
| 3,065,155 | 11/1962 | Welsh | 204/96 |
| 3,671,205 | 6/1972 | Uchida et al. | 428/623 |
| 3,752,708 | 8/1973 | Newell et al. | 148/31.5 |
| 3,900,385 | 8/1975 | Era et al. | 204/96 |
| 3,960,610 | 6/1976 | Steinbrechen et al. | 148/31.5 |

FOREIGN PATENT DOCUMENTS

| | | | |
|---|---|---|---|
| 46-25608 | 7/1971 | Japan | 428/656 |
| 52-7333 | 1/1977 | Japan | 428/659 |

OTHER PUBLICATIONS

Dirnfeld, S., et al.; "Manganese Diffusion Coating of Steels", *Journal of the Iron and Steel Institute* pp. 670–674 (9/72).

*Primary Examiner*—Michael L. Lewis

*Attorney, Agent, or Firm*—Cushman, Darby & Cushman

[57] ABSTRACT

Manganese coated steel materials having a compact film of hydrated manganese oxide formed on the manganese coating by heating and drying. Manganese coated steel materials of the present invention show very excellent corrosion resistance in ordinary corrosive environments as well as special corrosive environments such as marine environments and young plant cultivation in mountaineous forests. For further improvement of corrosion resistance, organic coating and metal coatings are applied.

6 Claims, 8 Drawing Figures

MANGANESE SURFACE COATED STEEL MATERIALS

BACKGROUND OF THE INVENTION

Field of the Invention

The present invention relates to surface coated steel materials in various forms having a manganese coating thereon and a fine and compact hydrated manganese oxide formed on the manganese coating, which steel materials show excellent corrosion resistance, workability and weldability.

As well known, the means for providing corrosion resistance for a steel material includes:

(1) Addition of alloying element (for example, stainless steels, atmospheric corrosion resistant steels, etc.)

(2) Organic coatings and inorganic coatings (for example, paints, synthetic resins, mortar, enamels, etc.)

(3) Metallic coatings (for example, zinc, tin and aluminum coatings, etc.)

Among the above surface protective means, the metallic coatings have been most widely used, and zinc-coated steel materials, in particular, have been and are used in tremendous amounts for manufacturing materials for buildings, automobiles, electric appliances and also used in the forms of wires and sections.

However, as zinc-coated steel materials have been increasingly used in various applications as mentioned above and under severe service conditions, a conventional single zinc-coating or single metal coating has not always been able to satisfy requirements and recent trends are that a composite or alloy coating is applied to steel materials so as to improve the properties.

This is due to discoveries and knowledges obtained through long-year experiences that the corrosion resistance effect of zinc (or zinc alloy) based on its nature that it is electrochemically baser than iron, namely due to its sacrificial anodic action, can not be maintained if the corrosive media is very severe and the dissolution of zinc is so rapid.

For example, referring to a colored galvanized iron, which has been widely used for building materials, a zinc-coated or alloyed zinc-coated steel plate is used.

However, the environments to which the zinc-coated or alloyed zinc-coated steel sheet is exposed usually contain corrosive media, such as water, oxygen and salts, so that the coated zinc dissolves in a very short period of service, thus developing red rust due to the corrosion of the base steel sheet, and further promoting the corrosion of the base steel sheet itself. Therefore, the zinc-coated steel sheet is seldom used in this field without a further surface treatment.

Thus, the zinc-coated steel material is usually subjected to a surface conversion treatment, such as chromating and phosphating, suitable for zinc, after the zinc coating, and further subjected to organic coatings compatible to the surface conversion treatment for the purpose of improving the corrosion resistance and in view of the ornamental appearance. However, even when a steel material is coated with a composite coating of the zinc-coating, the conversion coating and the organic coating, the coated zinc is first attacked easily by the corrosive substance, such as water, oxygen and salts which permeate through the organic coating, and then the organic coating itself is apt to be easily destroyed by the substances produced by the corrosion of the zinc coating. Further, in the case where the conversion treatment, such as chromating is done for the purpose of improving the adhesion with an organic coating, there is a problem of public pollution due to the hexavalent chromium ion present in the chromate film. Therefore, strong demands have been made for development of a surface treated steel sheet having improved corrosion resistance than the conventional materials.

As mentioned above, in the case when a zinc-coated steel material having an organic coating on the zinc coating, the corrosion resistance of the zinc coating itself is very important, just as when the zinc-coated steel material is used without an organic coating thereon, and for this reason the recent technical tendency is directed toward inhibition of the sacrificial anodic action of the coated zinc and commercial trials have been made to artificially make the galvanic electrode potential of the zinc coating approach to that of iron by alloying the zinc coating with iron, aluminum, nickel, molybdenum, cobalt etc. resulting in developments of Zn-Fe alloy coated, Zn-Al alloy coated, Zn-Mo-Co alloy coated steel products, which are now in the market.

These alloyed zinc coatings are said to have a corrosion resistance 2 or several times better than that of the conventional zinc coating, but the Zn-Fe alloy coating has difficulty in working, the Zn-Al alloy coating has problems in workability, weldability and paintability, thus failing to provide a coated material having a satisfactory integrated property, and although the Zn-Mo-Co alloy coating seems to provide the desired integrated property, it is very difficult to form the alloy coating of uniform composition, because each of the component metals shows a different electrodeposition speed depending on the electroplating conditions.

Therefore, in recent years strong demands have been made in various fields for the balanced property, namely for a commercial development of a surface coated steel material having excellent workability and weldability as well as satisfactory paintability and adaptability to chemical conversion treatments, but up to now, there is no surface coated steel material which can meet with the above requirements.

For improving the corrosion resistance of a steel material by coating the steel material with other metals and utilizing the corrosion resistance of the coated metals, there are two groups of coating methods, as classified electrochemically; the first group in which a metal nobler than iron is coated, for example chromium plating; the second group in which a metal baser than iron is coated, for example, zinc plating. For the first group of methods, many studies have been made and many arts have been established. However, when the metal coating itself has pinholes, or when the thickness of a coating increases, the coating is susceptible to cracking, as seen in the chromium coating. In either case, the metal coating has a defective portion, so that the steel substrate is first attacked because iron is electrochemically baser than the coated metal, just contrary as in the zinc coating, so that pitting corrosion is apt to occur, thus deteriorating the reliability of the coated steel material.

In view of the above facts, it may be concluded that a metal, such as zinc, which shows the sacrificial anodic action is more advantageous for protecting steel materials from corrosion. The present inventors made systematic studies in consideration of the above technical points of view, and have found that among various coated steel materials, a manganese coated steel material having a hydrated manganese oxide formed thereon shows the best corrosion resistance. As clearly understood from the galvanic series of metals in an aqueous solution, as manganese is electrochemically baser than zinc, it has been undoubtedly expected that manganese has an inferior corrosion resistance as compared with zinc.

Regarding the electrodeposition of manganese, many various studies have been made including "Electrolytic Manganese and Its Alloys" by R. S. Dean, published by the Ronald Press Co., 1952; "Modern Electroplating" by Allen G. Gray, published by John Willey & Sons Inc., 1953; "Electrodeposited Metals Chap. II, Manganese" by W. H. Safranek, published by American Elsevier Pub. Co., 1974, and "Electrodeposition of Alloys", Vol. 2 "Electrodeposition of Manganese Alloys" by A. Brenner, published by Academic Press, 1963.

According to R. S. Dean, the electrodeposition of manganese and its alloys act self-sacrifically anodically just as zinc and cadmium in the aspect of rust prevention, and a steel sheet having 12.5μ thick manganese coating can well resist to the atmospheric exposure for 2 years, and Allen G. Gray reported by citing "Sheet Metal Industry", 29, p. 1007 (1952) that a satisfactory protective effect can be obtained by a thick manganese coating and that the electrolytic manganese becomes black when exposed to air, but this can be prevented by an immersion treatment in a chromate solution.

Further, according to N. G. Gofman, as reported in "Electrokhim Margantsa" 4, pp. 125–141 (1969), the electrodeposited manganese corrodes in the sea water at a rate by 20 times faster than zinc, but the corrosion rate of manganese can be decreased when a chromate film is provided on the manganese.

What is more interesting is reported by A. Brenner. He pointed out the following three defects of the manganese or its alloy coatings, although he mentioned a protective film for steels or low alloyed steels as one of the expected applications of the manganese or manganese alloy coatings.

(1) Brittleness
(2) Chemical reactivity (a short service life in an aqueous solution or outdoors)
(3) Dark color of corrosion products (unsuitable for ornamental purposes yet suitable for a protective coating).

Regarding the brittleness, manganese electrodeposited from an ordinary plating bath, has a crystal structure of $\gamma$ or $\alpha$, and the $\gamma$ structure which is softer transforms into the $\alpha$ structure when left in air for several days to several weeks. Therefore, in practice, considerations must be given to the $\alpha$-manganese. In this case, the hardness and brittleness are said to be similar to those of chromium, i.e. 430 to 1120 kg/mm$^2$ expressed in microhardness according to W. H. Safranek.

Regarding the chemical reactivity, A. Brenner reported that the manganese or its alloys can be stabilized by a passivation treatment in a chromate solution, and the thus stabilized manganese or its alloys can stand satisfactorily stable for a long period of time in the indoor atmosphere, but he pointed out that for outdoor applications an eutectoid with a metal nobler than manganese should be used.

Therefore, judging from the fact that a zinc coated steel sheet with zinc coating of 500 g/m$^2$ by hot dipping can protect the steel sheet against corrosion for 30 to 40 years, a zinc coating of 90 g/m$^2$ by hot dipping which corresponds to a manganese coating of 12.5μ can be predicted to resist the atmospheric corrosion at least for 5 to 6 years, therefore a manganese coating which can resist to the atmospheric corrosion for only 2 years can not be said to have a better corrosion resistance than a conventional surface treated steel sheet.

Up to now no trial or study has ever been made to improve the corrosion resistance of a steel material by manganese coating thereon, except for the invention made by the present inventors as disclosed in Japanese Patent Laid-Open Specifications Sho 50-136243 and Sho 51-75975.

The present invention is clearly distinctive over these prior arts in the following points.

The Japanese Patent Laid-Open Specification Sho 50-136243 discloses a surface treated steel substrate for organic coatings, which is obtained by electro-plating 0.2μ to 7μ manganese coating on the steel material, and by subjecting the manganese coated steel material to a chromate treatment or a cathodic electro-conversion treatment in a bath of aluminum biphosphate or magnesium biphosphate or both. The technical object of this prior art is to facilitate the conversion treatments by coating manganese because it is difficult to apply in substitution for zinc coating conversion treatments such as the chromate treatment and aluminum biphosphate and magnesium biphosphate treatments directly to the steel material, and also it has an object to improve the paintability and further the corrosion resistance.

The Japanese Patent Laid-Open Specification Sho 51-75975 discloses a corrosion resistant coated steel sheet for automobile, which comprising a steel substrate containing 0.2 to 10% chromium and at least one layer of coating of zinc, cadmium, manganese or their alloys in a total thickness of 0.02μ to 2.0μ. This prior art is based on the fact that when the chromium content exceeds 0.5%, the crystal formation on the surface becomes increasingly scattered during the phosphate treatment, for example, and when 3% or more of chromium is contained, completely no phosphate crystal is formed, so that an excellent corrosion resistance of a steel substrate can be obtained, and that it is effective to apply only on the steel surface a single layer or multiple layers of coating of zinc, cadmium, manganese or their alloys which are very reactive to the conversion treatments.

As explained above, the prior arts which were also made by the present inventors utilized the nature of manganese that it has a stronger chemical reactivity than zinc for improvement of applicability of a steel material to chemical conversion treatments, and provide a steel substrate for paint coating. Therefore, these prior arts did not review the corrosion resistance of the hydrated manganese oxide formed on the manganese coating.

The reason why the manganese coating exhibits excellent corrosion resistance is that the thin layer of the hydrated manganese oxide formed on the metallic manganese coating is hardly dissolved in water, and serves as a kind of passivated film and contributes to corrosion resistance as contrary to a pure manganese metal which is very reactive.

Thus when metallic manganese is electrochemically deposited using a usual sulfate bath, the metal manganese reacts with oxygen in the air, and manganese hydroxide formed in a thin film during the electroplating is oxidized by the air and the oxygen-containing manganese compound is formed according to the following formulae (1) and (2).

$$2Mn(OH)_2 + O_2 \rightleftharpoons 2H_2MnO_3 \quad (1)$$

$$H_2MnO_3 + Mn(OH)_2 \rightleftharpoons Mn.MnO_3 + 2H_2O \quad (2)$$

This oxygen-containing manganese compound hardly dissolves in a neutral salt solution or in water and provides a very stable corrosion resistant film, completely different from the metallic manganese.

An oxygen-containing metal compound, such as the oxygen-containing manganese compound, is known to contribute to corrosion resistance just as a stainless steel exhibits excellent corrosion resistance due to its passivated surface film of a hydrated oxide containing 20 to 30% water, and a thinly chromium coated tin-free steel exhibits excellent corrosion resistance and excellent paintability due to its oxyhydrated chromium compound film containing about 20% water. It is also known that the rust of steel exposed to the air for a long period of time contains non-crystalline oxyhydrated iron compound, FeOOH, and that the rust layer of an atmospheric corrosion resistant steel which exhibits excellent resistance to atmospheric corrosion contains much of such oxyhydrated iron compound.

As described above, in the case of manganese, too, the oxygen compound containing water in the film is considered to have a remarkable effect on the corrosion resistance, and particularly advantageous in the corrosive environments, such as the marine splash zone, where $Cl^-$ ion is a main corrosion factor and highways where salts are sprayed for the purpose of prevention of freezing as practised in U.S.A., Canada and Europe, because $Cl^-$ ion tends to promote the transformation of $Mn.MnO_3$ to MnOOH having better corrosion resistance.

The prior arts as disclosed in Japanese Patent Laid-Open Specifications Sho 50-136243 and Sho 51-75975 took no consideration to the hydrated manganese oxide formed on the manganese coating, or regarded it as a corrosion product which damages the ornamental value. The present invention, for the first time, intends to form intentionally this hydrated manganese oxide on the manganese coating and utilize it advantageously.

Detailed descriptions will be made on corrosion of steels in marine environments.

Steel materials have been also widely used in marine structures because they cost low and easy to work. However, the marine environment is quite different from ordinary environments and is very severely corrosive to the steel materials due to the salt, and special considerations against the sea water corrosion must be taken.

The corrosion of a large steel structure extending continuously from the sea bottom upward above the sea surface is schematically shown in FIG. 8, from which it is understood the most severe corrosion is seen in the "splash zone" and the portion just below the ebb tide line.

The reasons why the corrosion is severe in the splash zone are considered as that the sea water is intermittently splashed over the structure and the steel is heated by the sun to a considerably high temperature, so that the steel is exposed to alternative repetition of drying and wetting under a heated condition and the corrosion is promoted so rapidly that the corrosion rate per year can reach 0.3 to 0.5 mm in average.

Meanwhile, the reasons for the severe corrosion of the steel in the portion just below the ebb tide line are considered as that the portion above the ebb tide portion is supplied with more oxygen than the portion below the sea surface, so that a so-called galvanic cell is formed between the portion just below the sea surface and the portion just above the sea surface and the portion just below the sea surface is more attacked while the portion above the sea surface is less attacked, the former corrosion rate reaching as much as 0.1 to 0.3 mm per year as compared with 0.1 mm or less per year of the latter corrosion.

The corrosion of the steel material, somewhat deeper in the sea, is 0.05 to 0.1 mm per year, depending on factors such as the oxygen dissolved in the sea water, the sea water temperature, the velocity of the sea water, the quality of the sea water, and the bacteria in the sea water, etc.

Meanwhile, the corrosion of the steel materials in the sea bed is much less, because the dispersion of the dissolved oxygen is the slowest.

As described above, the corrosion of steel materials in the marine environments varies depending on the positions at which the steel materials are used, and a preventive means against the corrosion of the splash zone has been regarded as the most important in the marine applications.

SUMMARY OF THE INVENTION

Therefore, one of the objects of the present invention is to provide a coated steel material having excellent corrosion resistance, workability and weldability, which coated steel material comprising a manganese coating on the base steel material and a film of hydrated manganese oxide formed on the manganese coating.

Another object of the present invention is to provide various coated steel materials made from the above coated steel materials such as steel materials useful for marine applications and cultivating plates useful for young plants.

Still further object of the present invention is to provide an apparatus for producing the coated steel material.

For achieving the above objects, the present invention is characterized in that:

(1) a corrosion resistant coated steel material comprising a manganese coating and a film of hydrated manganese oxide formed on the manganese coating;

(2) a coated steel material useful for marine applications comprising a manganese coating in a thickness from 2.8 to 11μ, having a film of hydrated manganese oxide in a thickness from 400 to 1000 Å;

(3) a coated steel material useful for marine applications, comprising a manganese coating in a thickness from 2.8 to 11μ, having a film of hydrated manganese oxide in a thickness from 400 to 1000 Å, a layer of zinc-rich paint in a thickness from 50 to 100μ coated on the film of hydrated manganese oxide, and a layer in a thickness from 200 to 900μ of resin selected from the group consisting of epoxy, tar-epoxy, urethane, vinyl and phenol coated on the zinc-rich paint coating;

(4) a coated steel material useful for marine applications, comprising a manganese coating in a thickness from 2.8 to 11μ, having a film of hydrated manganese oxide in a thickness from 400 to 1000 Å, and a film of rust-stabilizing coating mainly composed of polyvinyl butyral in a thickness from 20 to 60μ;

(5) a coated steel plate for cultivating young plants comprising a cold rolled steel plate of 50 to 150μ in thickness, a manganese coating in a thickness from 0.2 to 1μ having a film of hydrated manganese oxide in a thickness from 400 to 1000 Å.

Other objects and features of the present invention will be understood from the following detailed descriptions.

DETAILED DESCRIPTION OF THE INVENTION

Figure 1:
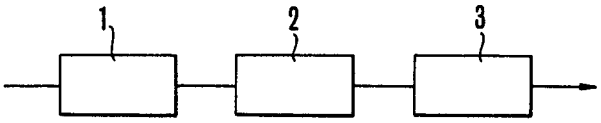
FIG. 1 to FIG. 3 show respectively a schematic view of a train of apparatus for production of the coated steel material according to the present invention.

The present invention is characterized in that the film of hydrated manganese oxide is formed, in a thickness enough to stand the subsequent operations such as coiling and piling, instantaneously by oxidation heating at a temperature ranging from 40° to 260° C. to such a degree that an interference color can be observed by naked eyes, and this film is intentionally utilized, thus eliminating the necessity of a chromate treatment, an aluminum biphosphate or magnesium biphosphate treatment, and a phosphate (zinc-phosphate) treatment as widely used in the automobile industry. Thus, it has been found by the present inventors that the hydrated manganese oxide formed on the metallic manganese coating as well as the metallic manganese coating is dissolved during the above conversion treatments, and it is advantageous to utilize the hydrated manganese oxide as well as the metallic manganese coating alone without the subsequent conversion treatments in view of material and energy saving.

The hydrated manganese oxide formed on the metallic manganese coating is a non-crystalline substance and contains water, so that it shows excellent adhesion with an organic coating when the coating is applied directly thereon, and does not require a conversion treatment, such as a chromate treatment and a phosphate treatment, as required by a zinc-coated steel material for improving the paint adhesion.

Therefore, the coated steel material according to the present invention can omit the conversion treatment and is very economically and technically advantageous.

As described above, in the present invention, a compact film of hydrated manganese oxide is formed rapidly by oxidation heating on the metallic manganese coating, thereby improving markedly the rust preventing effect of manganese. This inventive idea is applicable, when manganese is electrolytically coated, to all metals which are electrochemically nobler than manganese, except for alkali metals and alkali earth metals which are electrochemically baser than manganese.

The steel material on which the manganese coating is applied and the film of hydrated manganese oxide is formed, may include ordinary hot or cold rolled steel materials, in various forms, such as plates, wires and sections, irrespective to their strength and corrosion resistance, and further may include steel materials coated with nickel, zinc, tin, aluminum, copper, lead-tin, their alloys or oxides which are coated for various purposes, such as improving the corrosion resistance of the base metal. These intermediate coatings can be formed by a conventional method, electrically, chemically, by hot dipping, by spraying, or mechanically.

The manganese coating and the film of hydrated manganese oxide formed thereon are preferably in the following ranges of thickness.

Regarding the manganese coating, the thicker coating is more preferable in view of the corrosion resistance to be expected. However, the important role of the manganese coating expected in the present invention is to self-sacrificially and continuously provide the hydrated manganese oxide which is remarkably corrosion resistant through reaction with corrosive substances, such as water and oxygen in the corrosive environments. Therefore, it is necessary that the manganese coating, when applied directly to the base steel, is formed in a thickness enough to coat the base steel, and its thickness can be determined in view of the required corrosion resistance. As illustrated in the examples set forth hereinafter, it is preferable the manganese coating is formed in a thickness of not less than about 0.6μ.

Meanwhile, the upper limit of the manganese coating, is set at 8μ, because when the coating exceeds 8μ, the hardness becomes too high and hinders the workability, particularly in the case where a severe working is done as a cold rolled steel sheet.

Regarding the thickness of the film of hydrated manganese oxide formed on the manganese coating, it varies depending on the conditions of electrodeposition, the degree of oxidation by air, but as revealed by measurements by an electron spectroscopy for chemical analysis or other methods, it will not exceed 1000 Å, but will not be less than 200 Å. Therefore, in the present invention, the preferable thickness range of the film of hydrated manganese oxide is from 200 to 1000 Å.

Another most advantageous property of the coated steel material with the manganese coating having the film of hydrated manganese oxide formed thereon is its excellent spot-weldability. Thus in the case of an ordinary zinc-coated steel material, when the zinc coating is about 30 g/m$^2$ (about 4μ) or larger, the spot-weldability and the electrode life lowers as compared with a cold rolled steel material without zinc coating. However, the coated steel material according to the present invention can be spot-welded with the same conditions as the ordinary cold rolled steel material. In view of the spot-weldability, the upper thickness limit of the manganese coating is 8μ, which is identical to that for the corrosion resistance and workability. Therefore, the thickness range of the manganese coating as defined hereinbefore satisfies the requirement for the corrosion resistance, the workability and the weldability.

It is generally known that when a steel plate is subjected to forming, such as stretching and deep-drawing, crackings are more apt to occur as the thickness of coating is increased, and in the case of a zinc coating applied by hot dipping, cracks easily take place from the iron-zinc alloy during the forming even when the zinc coating is not so thick.

The coated steel material with the manganese coating having the film of hydrated manganese oxide according to the present invention shows excellent ability to adsorb lubricants (for example, petroleum lubricants such as paraffin, and naphthene and non-petroleum lubricants such as animal and vegetable oils, and synthetic oils) used in the forming step, so that not only the forming such as deep-drawing is markedly facilitated, but also the electrode contamination in the subsequent spot-welding can be effectively prevented and other handling operations, such as coiling and piling, can be done smoothly. The above lubricant is applied in an amount ranging from 0.5 to 5 $g/m^2$.

When other metals, alloys or metal oxides (for example, nickel, zinc, copper, tin, lead-tin, etc.) are coated on the base steel, the thickness of the manganese coating and the hydrated manganese oxide, particularly the thickness of the manganese coating to be applied on these intermediate coatings may vary because these intermediate coatings have their own rust preventing effects, but it is preferable the thickness is 0.4$\mu$ or thicker and regarding its upper limit, 8$\mu$ or less is enough.

Also, when the manganese coating having the film of hydrated manganese oxide formed thereon is applied only on one side of the base steel material, the other side is utilized as a non-coated steel surface. This provides an advantage that the non-coated steel surface has excellent paintability and weldability so that a wider application of welding and working can be provided, as compared with the conventional surface coated steel plates, and when this one-side coated steel plate is used as automobile sheets and for electrical appliances where outer sides of the steel sheets are painted for ornamental purposes, great advantages can be obtained. In this case the non-coated side may be applied with rust preventive oils as specified by JIS NP3.

Further, when the coated steel material according to the present invention is compared with a zinc-coated steel material concerning the results of salt spray tests (JIS-Z-2371) very similar to the condition of the "splash zone" of a marine structure as mentioned hereinbefore, it is revealed that the corrosion rate of the coated steel material according to the present invention is only about 8 $mg/m^2/hr$, which is about 1/125 of the corrosion rate (1 $g/m^2/hr$) of the zinc coated steel material.

Therefore, the coated steel material according to the present invention shows a surprising corrosion resistance in the "splash zone".

In the salt spray testings, as the loss of manganese stands in a linear relation with the testing time, it is understood that the corrosion resistance increases as the thickness of the manganese coating and the hydrated manganese oxide increases, so that the thickness of the coating may be determined in correspondence to the service life to be expected.

As described above, a satisfactory resistance to the corrosion in the splash zone in the marine structures can be achieved by the hydrated manganese oxide and the manganese coating in a thickness of several microns. However, when a better corrosion resistance is desired, an organic coating suitable for specific marine environments may be applied on the manganese coating having the hydrated manganese oxide formed thereon, and for this purpose wash primers or zinc-rich paints are coated according to the recommendations of NACE and then an epoxy, vinyl or chrolinated rubber paint is coated in an amount of about 250$\mu$. In this way, a satisfactory corrosion resistance in the splash zone can be obtained for marine structures, such as oil drilling rigs of about 10 year durability.

According to the findings by the present inventors, very excellent corrosion resistance against the corrosion in marine environments, particularly in the splash zone can be obtained by further coating a composite organic coating composed of a base layer of polyvinyl butyral, an intermediate layer of one of iron oxide, zinc phosphate, and zinc chromate, and an upper layer of an acrylic resin, as disclosed in Japanese Patent Publication Sho 53-22530, on the manganese coating having the hydrated manganese oxide formed thereon.

Descriptions will be made hereinbelow on the thickness requirements of the manganese coating and the hydrated manganese oxide and the thickness requirements of the organic coating applied for the purpose of rust prevention in connection with the marine applications.

The hydrated manganese oxide is formed by a forced oxidation after the washing following the manganese plating, and its thickness depends on the electroplating conditions and the degree of oxidation by air. When the manganese plating is performed in an ordinary sulfate bath, and the forced oxidation is done at a temperature ranging from 40° to 260° C. after the washing, the hydrated manganese oxide will have an interference color when the thickness is within the range from 400 to 1000 Å, will be non-uniform when the thickness is less than 400 Å, and will be much susceptible to peeling off during working, transportation or by mechanical impacts when the thickness exceeds 1000 Å. Meanwhile, a satisfactory corrosion resistance will be obtained by a thickness not thicker than 1000 Å. Therefore, the thickness range of the hydrated manganese oxide is from 400 to 1000 Å.

As mentioned hereinbefore, the manganese coating maintains the corrosion resistance by self-complemental supply of the hydrated manganese oxide in response to its gradual corrosion in a corrosive environment. Therefore, from the theoretical point of view the manganese coating is required at least to uniformly and continuously cover the steel surface and for this purpose only about 0.3$\mu$ of manganese coating is enough. However, for the purpose of maintaining corrosion resistance, a thicker manganese coating is more preferable. Supposing that the coated steel material of the present invention is applied to a marine structure of expected durability of 20 to 50 years, the lower limit of the manganese coating is 2.8$\mu$ while the upper limit is 11$\mu$ for the reasons set forth hereinbefore. Therefore, the thickness range of the manganese coating is from 2.8 to 11$\mu$ for the marine applications.

Regarding the organic coating, when 50 to 100$\mu$ of a zinc-rich paint as the under-coating and 200 to 900$\mu$ of one of epoxy, tar-epoxy, ulethane, vinyl and phenol resins as the over-coating are on the aobve manganese coated steel material, the durability can be elongated by 8 to 10 years. Also when a polyvinyl butyral coating is applied on the above manganese coated steel material, 20 to 60$\mu$ of the coating is enough for corrosion resistance for about 10 years.

The above organic coatings, the manganese coating and the hydrated manganese oxide can be applied irrespective to the strength, toughness, weldability and corrosion resistance of the base steel material, and irrespective to the shape of the base steel material, thus applicable to all grades and shapes of steel materials. For example, a steel plate of 25 to 150 mm in thickness usually used for marine structures in manganese plated in a sulfate bath, washed, dried, cut into sizes, welded, partially manganese plated only on the welded portions by a portable electroplating machine, and hydrated manganese oxide is formed on the welded portions by a hot blast dryer just as on the base steel portion.

Needless to say, it is possible to produce the hydrated manganese oxide and the manganese coating easily by a portable electroplating machine and a heating device after forming, welding and assembling processes.

Further, the present inventors have found the manganese coated steel material having the film of hydrated manganese oxide formed on the manganese coating is very useful for cultivating young plants.

Figure 9:
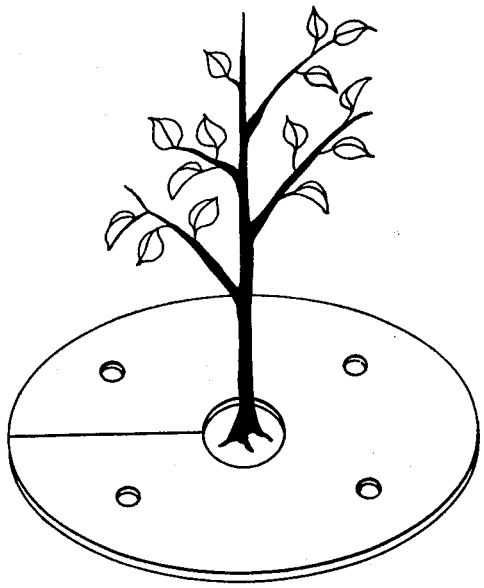
FIG. 9 shows a young tree cultivating plant made of the coated steel material according to the present invention.

For tree planting, young plants are planted in the center of a simple-structured protecting and shielding plate usually called "cultivating plate" as shown in FIG. 9 made of carboard, plastics or a paint-coated steel plate so as to protect the young plants from weeds and animals for several years until they grow enough large.

The cultivating plate is intended to protect the young trees for 5 to 6 years until they grow enough large, and therefore, it is most desired that the cultivating plate is corroded away in 5 to 6 years from the view point of saving the labour required to remove the used cultivating plates as well as from the view point of keeping the mountains and forests clean.

On the other hand, it is known that the corrosion rate of ordinary carbon steel in fields, mountains and forests is most severe in the initial 4 years, and is slightly moderated thereafter, with an average corrosion rate of 100 $mg/cm^2$ for six years, which corresponds to 0.13 mm thickness of the steel plate.

The above corrosion rate is an average value, and usually the corrosion of the steel progresses locally in the weak portions of the steel, causing pitting corrosions and local corrosions, and the pitting corrosion progresses at a rate 3 to 5 times higher than the average corrosion rate. Therefore, when a durability of 6 years is expected, 0.39 to 0.65 mm thickness of the steel is required. From this, a cold rolled steel plate of 0.5 to 0.6 mm in thickness is satisfactory for the cultivating plate. However, from the points of saving the iron source and saving the cost, as well as from the point of the labour required for transporting the cultivating plates, it is desired to decrease the thickness of the cold rolled steel plate in combination with surface treatments, and to obtain a uniform corrosion of the plate without local corrosions.

The present inventors have found the above requirements can be satisfied by a cold rolled steel plate of 50 to 150$\mu$ in thickness coated with 0.2 to 1$\mu$ manganese coating and 400 to 1000 Å hydrated manganese oxide film formed on the manganese coating.

Hereinbelow, descriptions will be made on the apparatus for producing the coated steel material according to the present invention referring to the attached drawings.

In FIG. 1, a manganese plating device 1, a washing device 2 and a heating device 3 are successively arranged to constitute a continuous coating apparatus train. This train may be arranged in a horizontal pass, a vertical pass or their combination pass.

It is desirable that the manganese plating device is provided with a manganese source supplying device, and that this supplying system as well as a manganese material dissolving system are provided with an automatic control mechanism actuated by detected values such as the manganese concentration in the plating bath, pH values of the bath and the amount of electrolyte.

Regarding other structural requirements, it is desirable that the anodes opposing to corresponding sides of the steel material are variable independently in their current density so as to change the coating thickness on both sides of the steel material, and that only one electrode is independently operable by current passage to enable one-side plating of the steel material. The electrolyte is circulated between the storage tank and the plating tank provided with the electrodes at a velocity which can avoid adverse effects on the quality of coating by air foams generated on the surfaces of the steel material and the electrode. In the case of a horizontal pass arrangement, it is desirable that it is possible to control the circuration rate of the electrolyte, so as to expose the upper electrode above the electrolyte surface for achieving one-side plating.

The washing device 2 arranged after the plating tank 1 functions to wash off almost completely the electrolyte carried by the steel material from the preceding plating step, and the washing is done with cold or hot water by spraying or immersion. If necessary, a brushing device etc. may be used in combination with the washing device.

The heating and drying device or furnace arranged after the washing device 2 functions to form a compact film or hydrated manganese oxide on the manganese coating, and is so designed that the heating temperature can be controlled so as to heat the steel material to a predetermined temperature even when the travelling period of the steel material through the device changes due to the line speed, for example.

An oxidizing atmosphere containing oxygen in an amount enough to form the compact hydrated manganese oxide in maintained in the heating and drying furnace. For heating, any type of treating, such as gas heating, electric heating and heat rays heating, may be used.

Figure 2:
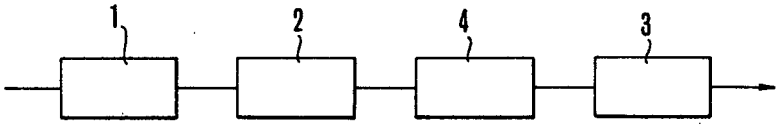

A modification of the apparatus train is shown in FIG. 2, in which an organic coating device 4 for coating a water-soluble or water dispersion type paint is arranged after the washing device 2, and this organic coating device may be of a spray type, a roll coater type, an immersion type or an electrodeposition type, and is capable of coating the wet steel material immediately after it is washed in the washing device 2.

The heating and drying device or furnace 3 arranged after the organic coating device 4 is designed so as to produce compact hydrated manganese oxide on the manganese coating given in the plating tank, and at the same time to complete the formation of the organic coating.

The curing temperature of the organic coating ranges usually from 80° to 260° C., depending on the nature of paints used, and this temperature range is almost the same as the temperature range for producing the compact hydrated manganese oxide.

Therefore, the heating device 4 is designed so as to be capable of controlling the furnace temperature in correspondence to the travelling speed of the steel material through the furnace. The heating may be gas heating, electric heating or heat rays heating.

Figure 3:
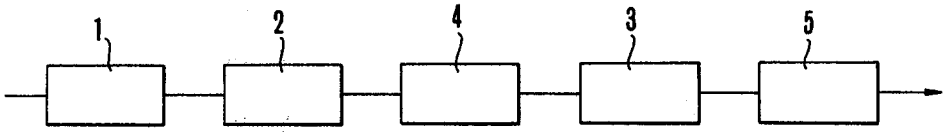

Another modification of the apparatus train is shown in FIG. 3, in which an oil coating device 5 is arranged after the drying device 3, and this oil coating device continuously coats lubricants, such as petroleum and non-petroleum lubricants by mist-spraying or electrostatic coating.

In this modification, the oil coating is selectively applied on the film of hydrated manganese oxide or on the organic coating on the film of hydrated manganese oxide, and for this purpose, the organic coating device 4 is made empty when the oil coating is to be made on the hydrated manganese oxide, and if the organic coating device is of a spray type, the spraying is stopped, if the device is of a roll coater type, the coater is separated from the steel material, and if the device is an immersion type, the device is so designed as to take out the steel material from a treating tank to a storage tank.

More detailed descriptions of the apparatus shown in FIG. 1 will be made referring to FIG. 4.

The steel strip 11 is introduced through the rolls 12 into an electric manganese plating tank 13 in which a non-soluble electrode is provided in a plane parallel to the steel strip. The non-soluble electrode may be made of Pb, C, Ti or Pt, but when a sulfate bath is used for the manganese plating, a Pb electrode containing several percents of Sn and Sb is more stable and is operable in a wider bath temperature range than a pure Pb electrode. The electrolyte is circulated from the storage tank 14 through a pump $P_1$ to the plating tank 13, and to the storage tank 14. If the plating is done continuously for a long period of time $Mn^{+2}$ ion in the circulating electrolyte becomes short. Therefore, $Mn^{+2}$ ion is made up by supplying a manganese source 16, such as metallic manganese particles, and manganese carbonate powder, to the electrolyte in a dissolving tank, where the manganese source is dissolved in the electrolyte under stirring. Thus, the concentration of manganese in the electrolyte, the pH value of the electrolyte, and the level of the electrolyte for controlling the amount of the electrolyte are detected in the storage tank 14 by detecting elements. When the shortage of $Mn^{+2}$ is detected, the pump $P_2$ is automatically actuated through a controlling mechanism to send the electrolyte from the storage tank 14 to the dissolving tank 15, where the electrolyte dissolves the manganese source 16, such as metallic manganese particles or manganese carbonate powder, charged in the tank to provide an electrolyte containing a high concentration of $Mn^{+2}$ ion and thus replenished electrolyte is returned to the storage tank 14. The amount of the manganese coating to be applied on the steel strip is controlled by controlling the amount of current given to the rolls 12 and the electrode in correspondence to the line speed by means of a controlling device 19. Other factors which are usually controlled in an electrolytic plating are controlled by suitable control mechanisms.

The steel strip on which manganese coating is made is removed of adhering excessive electrolyte through squeezing rolls and introduced into the rinsing tank 17 where washing with cold or hot water is done by spraying or immersion, and if necessary a brushing device is used. Then the steel strip is again removed of excessive rinsing water through squeezing rolls and introduced into a heating and drying furnace 18, where any water remaining on the surface of the manganese coating is evaporated and the strip is heated to temperatures which develop a visual interference color on the manganese coating. The heating and drying device 18 has a heating capacity to heat the strip at a temperature between 40 and 260° C. at the highest line speed, under the above heating and drying conditions, a film of stable and compact hydrated manganese oxide is produced on the manganese coating.

Figure 7:
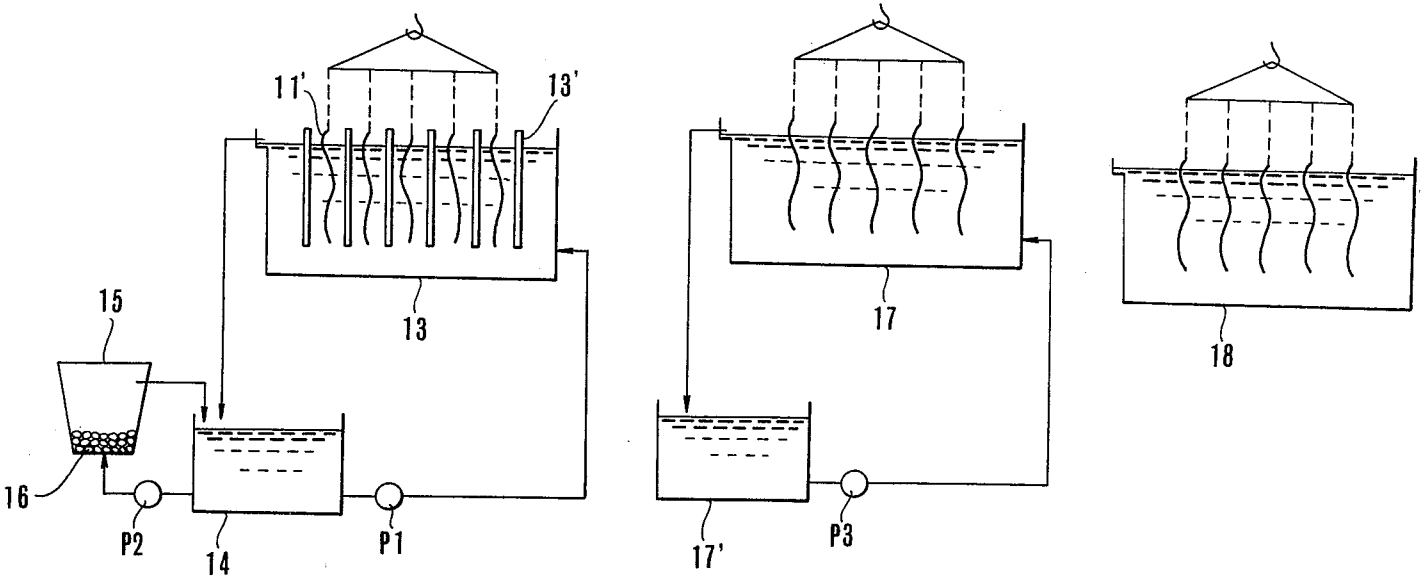
Figure 8:
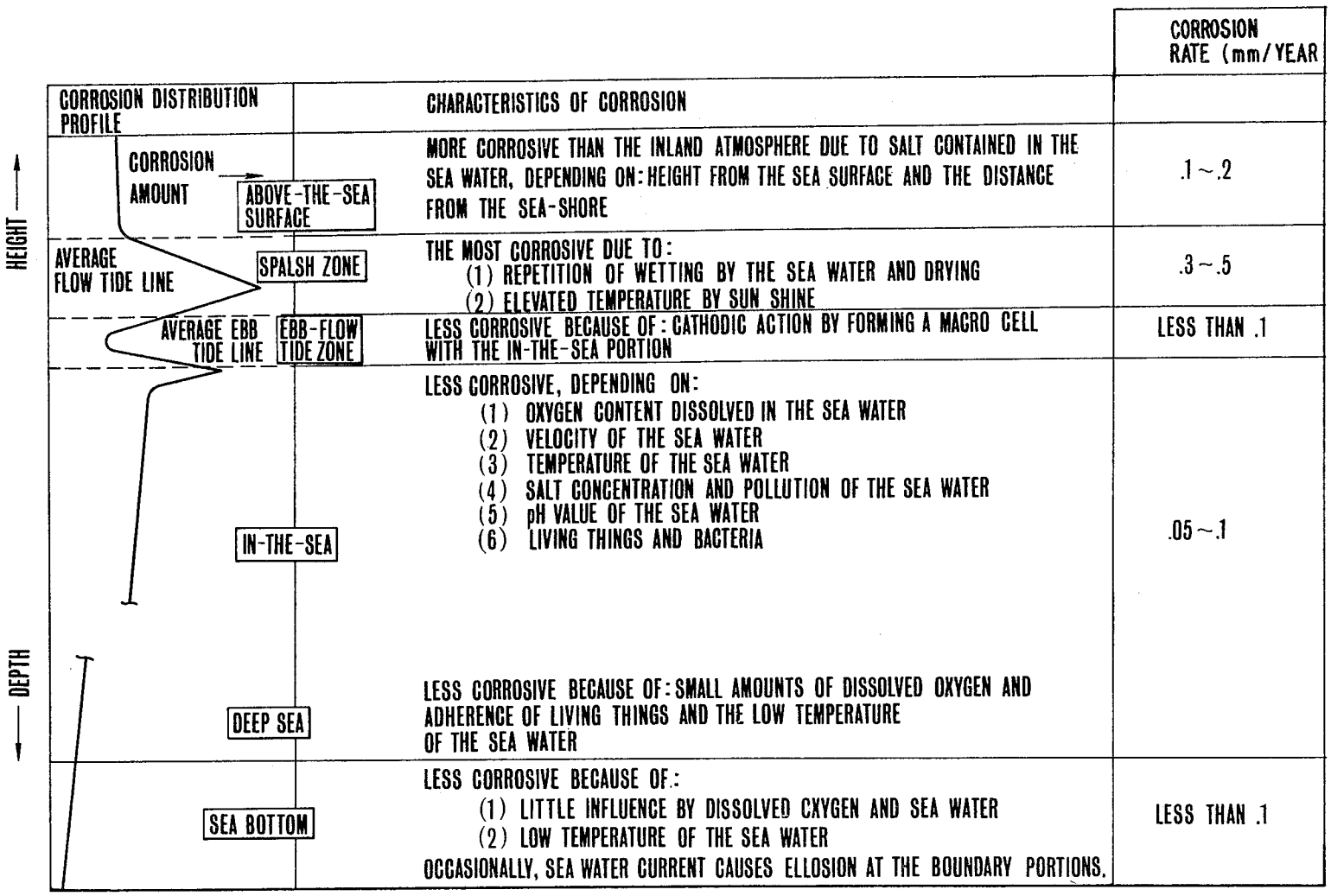
FIG. 8 shows the corrosion distribution in a marine steel structure in a marine environment.

Descriptions will be made on the apparatus as applied for coating guard rails referring to FIG. 7.

A cleaned guard rail 11' is immersed in an electrolytic manganese plating tank 13 provided with a plurality of non-soluble plate electrodes 13' in a plane parallel to the suspended guard rail, current is passed for a predetermined time to give a required thickness of manganese coating on the guard rail, and the guard rail is lifted up and introduced in a washing tank 17. The rinsing liquid is circulated between the washing tank 17 and a storage tank 17' through a pump $P_3$, and when the liquid becomes contaminated, part thereof is removed and made up by fresh liquid to maintain a required purity.

After washing, the guard rail is introduced into a heating and drying furnace 18, in which many guard rails are simultaneously heated with combustion gas for a predetermined time to produce a compact film of hydrated manganese oxide. If the bath temperature for manganese plating or the temperature of the rinsing liquid is maintained at a temperature from about 40° to 70° C., the rinsing liquid can be completely dried and a compact film of hydrated manganese oxide can be produced even without heating and drying in the heating and drying furnace because heavy-weight steel products, such as guard rails, have a large heat capacity and thus the heating and drying furnace can be omitted.

Figure 5:
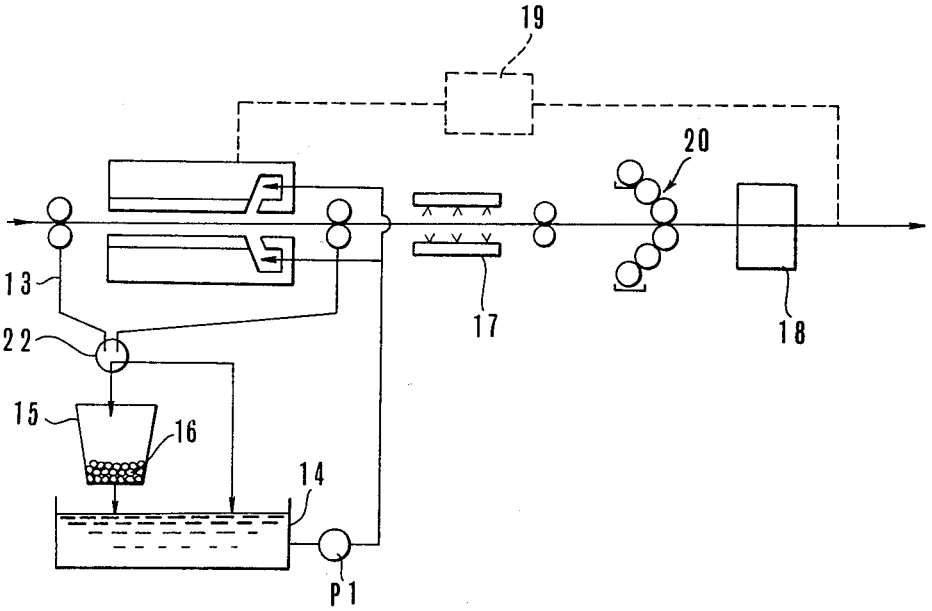

The first modification of the apparatus will be described in more details by reference to FIG. 5.

This modified apparatus is intended to continuously coat a water-soluble or water-dispersion paint on the film of hydrated manganese oxide, and comprises an electrolytic manganese plating device 13, a washing device 17, an organic coating device 20 and a heating and drying device 18 successively arranged in the written order.

Figure 4:
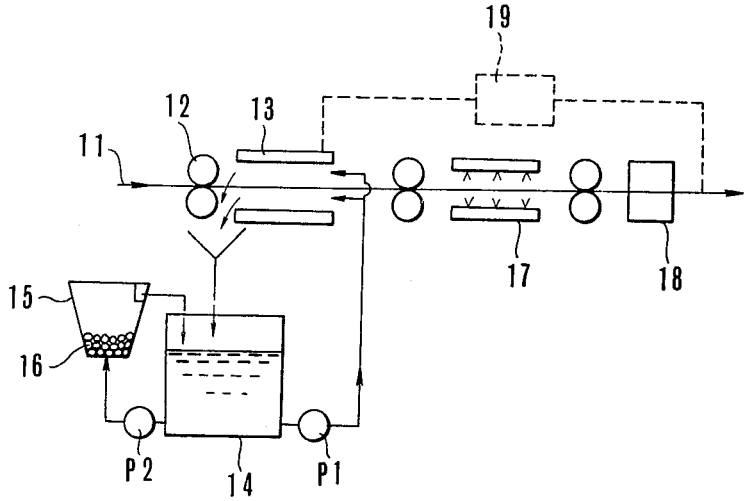
FIG. 4 to FIG. 7 show respectively a specific embodiment of the apparatus for producing the coated steel material according to the present invention.

Contrary to the plating device shown in FIG. 4, the manganese plating device 13 is provided with a manganese source supplying device, and is capable of detecting the concentration of $Mn^{+2}$ ion in the electrolyte. For dissolving the manganese source in the manganese source supplying device, the return of electrolyte from the plating tank is sent directly to the electrolyte storage tank or introduced into the manganese supplying device by means of a change-over piping, in stead of a by-pass circulation from the electrolyte storage tank.

Regarding the organic coating to be continuously applied, a water-soluble or water-dispersion paint which is favourable to shop environments is used, and as these paints can be coated on the steel strip surface still wetted with water, the arrangement of the organic coating device 20 may be as previously described.

The organic coating device may be a roll coater, or a curtain flow coater. However, when the coating is to be done by electrodeposition, rolls and electrodes are provided inside and the washing tank is arranged after the electro-deposition coating tank. The steel strip coated with a paint is introduced in a heating and drying furnace 18 where it is dried and baked. The heating capacity of the furnace 18 must be enough to fully dry and bake the paint coating, but it is enough to heat the steel strip up to about 260° C. at the highest line speed. As stated hereinbefore, the formation of the film of hydrated manganese oxide is completed by this drying procedure.

Figure 6:
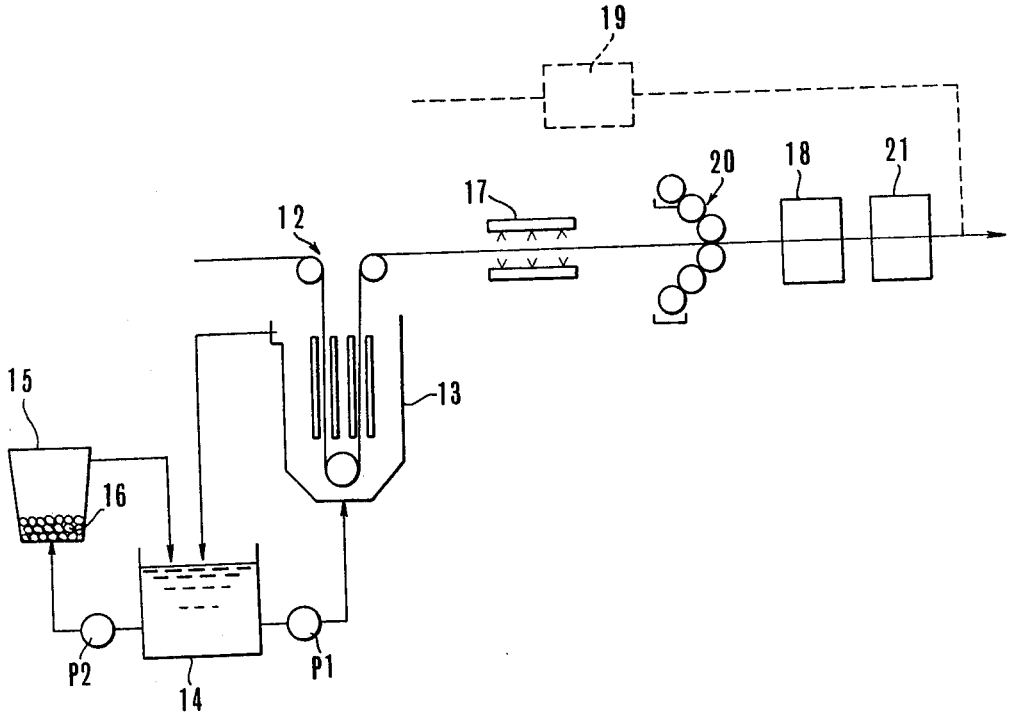

The second modification of the apparatus will be described by referring to FIG. 6.

The modification illustrates a manganese plating apparatus of vertical pass type. The non-soluble electrodes are arranged in four lines parallel to the steel strip to be plated. The electrolyte is supplied to the plating tank from its lower portion by a pump, and when the electrolyte fills the tank, the overflow flows down to the storage tank. In this modification, the oil coating device 21 for coating the lubricant on the uppermost surface of the continuously coated steel strip is arranged at the last end of the apparatus train shown in FIG. 1 and FIG. 2. The lubricant coated by this oil coating device may be a usual petroleum (paraffine or naphtene) or non-petroleum (animal, vegetable or synthetic oil) lubricant and the device may be of any ordinary type, such as mist-spraying type, electrostatic coating type.

The present invention will be better understood from the following examples.

EXAMPLE 1

Cold rolled steel strips of 0.8 mm thick were manganese plated in various thicknesses in an electrolytic bath (pH 4.2) of 100 g/l of manganese sulfate, 75 g/l of ammonium sulfate, and 60 g/l of ammonium thiocyanate, at a bath temperature of 25° C., a current density of 20 A/dm$^2$ and with a lead electrode. After the electroplating, the coated strip were washed with water, subjected to a rapid oxidation at about 80° C. (strip temperature) in 1 to 5 seconds by hot blast drying to produce a compact film of hydrated manganese oxide having a visible interference color on the manganese coating.

For comparison similar steel strips were zinc-coated, Fe-Zn alloy coated and coated with composite coating of iron-molybdenum-cobalt in various thicknesses, and salt spray tests (JIS Z2371) were conducted to determine the corrosion resistance of the steel substrates as coated. The test results are shown in Table 1, in which the test pieces marked with ◎ represent the coated steels according to the present invention. As clearly demonstrated, the steel materials having at least about 0.6μ manganese coating and the film of hydrated manganese oxide formed thereon show very excellent corrosion resistance in long time tests lasting 2000 hours.

EXAMPLE 2

Cold rolled steel strips of 0.8 mm thick were manganese plated and a compact film of hydrated manganese oxide was formed on the manganese coating under a rapid heating and oxidizing conditions in the same way as in Example 1, and folding tests were conducted to determine the peeling off of the manganese coating and the film of hydrated manganese oxide at the folded portion in comparison with the same comparative coated steel materials as used in Example 1. The test results are shown on the right column in Table 1, from which it is clear that satisfactory workability is assured by the coated steel material according to the present invention up to about 8μ thick of the manganese coating and the film of hydrated manganese oxide.

EXAMPLE 3

Cold rolled steel strips of 0.8 mm thick were coated with a manganese coating having a compact film of hydrated manganese oxide in a thickness ranging from 0.2 to 8.0μ under the same conditions as in Example 1, and their spot-weldability was tested under the most severe condition. Thus a single spot-welding was performed on two sheets by using an electrode of 4.5 mm diameter corresponding to RWMA class 2 material, with a pressure of 200 kg, and 10 cycles of current passage. In the spot-welding test, it is important how many spots can be welded until the strength of the portions to be spot-welded. Therefore, the spot-weldability was compared by using the number of spots which could be continuously welded. The preparation of the test pieces was made according to J3136. The test results are shown in Table 2.

As clearly shown by the test results, the steel material coated with the manganese and the hydrated manganese oxide according to the present invention shows far better weldability than the zinc-coated steel materials. Further, when 0.3 to 3 g/m$^2$ of a rust preventing oil (JIS NP3) is coated by a roll coater the so-called electrode contamination can be remarkably inhibited and welding performance as good as an ordinary cold rolled steel sheet can be obtained.

EXAMPLE 4

Cold rolled steel strips of 0.8 mm thick were plated respectively with nickel, copper, zinc, chromium, tin and lead-tin alloy by a commercially used method (electrolytic plating or hot dipping), and subjected to the manganese plating and the heating in a similar way as in Example 1 to obtain steel strips having a three layer coating of the uppermost layer of hydrated manganese oxide, the manganese layer and the layer of the above metal or alloy.

Comparative tests were conducted on these three layer coated steel strips for determining the corrosion resistance in salt spray tests, the workability estimated by the peeling off of the coating at worked portions in folding tests, and the spot-weldability estimated by the number of continuously welded spots in the same test as in Example 3 in comparison with nickel-plated and copper-plated steel materials. The test results are shown in Table 3.

As clearly shown by the results in Table 3, no change in the behavior of manganese is seen even when other metals or alloys are coated electrolytically or by hot dipping on the steel materials for the purpose of improving the corrosion resistance, and the coating of manganese and hydrated manganese oxide applied thereon can still further improve the corrosion resistance and does not give adverse effects on the workability and the weldability.

EXAMPLE 5

Cold rolled steel strips of 0.8 mm thick were subjected to the same manganese plating and the rapid heating and oxidizing treatment as in Example 1 to form about 600 Å thick manganese coating having hydrated manganese oxide thereon, and further coated with acrylic resin paints to determine properties of the steel materials having a composite coating. The acrylic resin paint was coated by an immersion method, and baked at 205° C. for 10 minutes. The thickness of the paint coating was adjusted by a controlling the amount to be coated using a thinner.

The tests were done by using a salt spray testing method (JIS Z2371) lasting for 1000 hours, and the test pieces were cross-cut so as to observe corrosion under the paint coating. The test results are shown in Table 4. It is revealed by the results that the coated steel material having the paint coating in a thickness not less than 0.1μ can show excellent properties.

EXAMPLE 6

Steel plates of 50 mm thick for welded structure were coated with manganese in various thickness in an ordinary sulfate bath (manganese sulfate 120 g/l, ammonium sulfate 75 g/l, Rhodan ammonium 60 g/l) at bath temperature of 30° C., a current density of 25 A/dm$^2$ using a Pb-Sn (5%) electrode, washed with water, and heated and dried at a temperature between 40° C. and 260° C. to form hydrated manganese oxide on the manganese coating. Further various paint coatings were applied and subjected to a salt spray test (JIS Z2371) and to an exposure test to marine environments (Higashihama, Hirohata, Japan) to determine their corrosion resistance in comparison with various non-coated and coated structural steel materials. The test results are shown in Table 5. The results clearly reveal that the coated steel material according to the present invention show very excellent corrosion resistance in the salt spray tests lasting for 2000 hours and the exposure tests for five years.

EXAMPLE 7 (Young plant cultivating plate)

Very thin cold rolled steel sheets of 0.1 mm thick (100μ) were coated with manganese in various thicknesses in an electrolytic bath (pH 4.2) composed of manganese sulfate 100 g/l, ammonium sulfate 75 g/l, ammonium thiocyanate 60 g/l at a bath temperature of 25° C., a current density of 20 A/dm$^2$ using a Pb-Sn (5%) electrode, washed with water, and dried by hot blast to form hydrated manganese oxide on the manganese coating. The coated steel sheets thus obtained were subjected to salt spray tests (JIS Z2371) to determine their corrosion resistance in comparison with steel sheets with zinc-coatings in various thicknesses or organic coatings in various thicknesses, the results are shown in Table 6. The coated steel sheets marked with ● in the table represent the present invention and show far better corrosion resistance than the zinc-coated steel sheets, and no rust is observed after 250 hours salt spray test when the coating of manganese and hydrated manganese oxide is 0.5μ thick and no red rust is observed after 500 hours salt spray test when the coating is 1μ thick, thus showing corrosion resistance as good as the comparative colored galvanized sheets which were prepared by coating in a 25μ thickness epoxy primer and silicon polyester on the one-side galvanized (137 g/m$^2$) sheets.

TABLE 1

| | Corrosion Resistance (Salt spray test JIS-Z-2371) & Workability | | | | | | | |
|---|---|---|---|---|---|---|---|---|
| | | Thickness of coatings (μ) | Thickness of Mn coating (μ) | Thickness of hydrated manganese oxide (Å) | Salt Spray Test 250 hrs. | 500 hrs. | 1000 hrs. | 2000 hrs. | Peeling off of coating at folded portions |
| | A Cold rolled steel sheet | — | — | — | XXX | XXX | XXX | XXX | O |
| | B Galvanized steel sheet | Zn 3 | — | — | XX | XX | XXX | XXX | O |
| | C Galvanized steel sheet | Zn 4 | — | — | XX | XX | XXX | XXX | O |
| | D Hot dipped Zn-coated steel sheet | Zn 14 | — | — | XX | XX | XXX | XXX | Δ (slightly peeled) |
| | E Hot dipped Zn-coated steel sheet | Zn 20 | — | — | XX | XX | XXX | XXX | Δ (slightly peeled) |
| | F Zn—Fe alloy coated steel sheet | Zn—Fe 6 | — | — | X | X | XX | XXX | X |
| | G Zn—Fe alloy coated steel sheet | Zn—Fe 8 | — | — | X | X | XX | XXX | X |
| | H Zn—Mo—Co composite coated steel sheet | Zn—Mo—Co 8 | — | — | X | X | XX | XXX | O |
| | I Mn coated steel material | — | 0.2 | 320 | X | X | XX | XXX | O |
| | J Mn coated steel material | — | 0.4 | 450 | O | X | XX | XX | O |
| ◎ | K Mn coated steel material | — | 0.6 | 400 | O | Δ | X | X | O |
| ◎ | L Mn coated steel material | — | 1.0 | 580 | O | O | O | O | O |
| ◎ | M Mn coated steel material | — | 4.0 | 720 | O | O | O | O | O |
| ◎ | N Mn coated steel material | — | 6.0 | 800 | O | O | O | O | O |
| ◎ | O Mn coated steel material | — | 8.0 | 950 | O | O | O | O | O |

Remarks:
O: good
Δ: less than 10% rust formation
X: less than 30% rust formation
XX: less than 60% rust formation
XXX: rust formation over whole surface

TABLE 2

| | Spot-Weldability | | | |
|---|---|---|---|---|
| | Test Pieces | Thickness of coatings (μ) | Thickness of Mn coating (μ) | Thickness of hydrated manganese oxide (Å) | Number of weld |
| A | Cold rolled steel sheet | — | — | — | 15,000 or more |
| B | Galvanized steel sheet | Zn 3 | — | — | 9,600 |
| C | Galvanized steel sheet | Zn 4 | — | — | 8,000 |
| D | Hot dipped Zn-coated steel sheet | Zn 14 | — | — | 2,700 |
| E | Hot dipped Zn-coated steel sheet | Zn 20 | — | — | 2,200 |
| F | Zn—Fe alloy coated steel sheet | Zn—Fe 6 | — | — | 12,000 |
| G | Zn—Fe alloy coated steel sheet | Zn—Fe 8 | — | — | 10,000 |
| H | Zn—Mo—Co composite coated steel sheet | Zn—Mo—Co 8 | — | — | 10,000 |
| I | Mn coated steel material | — | 0.2 | 320 | 15,000 or more |
| J | Mn coated steel material | — | 0.4 | 450 | " |

TABLE 2-continued

| | Test Pieces | Spot-Weldability: Thickness of coatings (μ) | Thickness of Mn coating (μ) | Thickness of hydrated manganese oxide (Å) | Number of weld |
|---|---|---|---|---|---|
| ◎ K | Mn coated steel material | — | 0.6 | 400 | " |
| ◎ L | Mn coated steel material | — | 1.0 | 580 | " |
| ◎ M | Mn coated steel material | — | 4.0 | 720 | " |
| ◎ N | Mn coated steel material | — | 6.0 | 800 | " |
| ◎ O | Mn coated steel material | — | 8.0 | 950 | 13,500 |

TABLE 3

Effects of Base Metal Coatings on Corrosion Resistance, Workability & Weldability

| | Coatings on the test pieces | Composition and thickness of base metal coating (μ) | Thickness of Mn coating (μ) | Thickness of hydrated manganese oxide (Å) | Salt spray test 1,000 hrs. | Salt spray test 2,000 hrs. | Folding test | Number of weld |
|---|---|---|---|---|---|---|---|---|
| ◎ 1 | Mn | — | 1.0 | 600 | O | O | O | 15,000 or more |
| 2 | Ni | Ni:1 | — | — | XXX | XXX | O | " |
| ◎ 3 | Ni + Mn | " | 0.5 | 450 | O | Δ | O | " |
| ◎ 4 | Ni + Mn | " | 1.0 | 650 | O | O | O | " |
| 5 | Cu | Cu:1 | — | — | XXX | XXX | O | " |
| ◎ 6 | Cu + Mn | " | 0.5 | 520 | O | O | O | " |
| ◎ 7 | Cu + Mn | " | 1.0 | 580 | O | O | O | " |
| 8 | Zn galvanized | Zn:3 | — | — | XXX | XXX | O | 9,600 |
| ◎ 9 | Zn + Mn | " | 0.5 | 510 | O | O | O | 15,000 or more |
| ◎ 10 | Zn + Mn | " | 1.0 | 630 | O | O | O | " |
| 11 | Cr | Cr:0.1 | — | — | XXX | XXX | O | 10,000 |
| ◎ 12 | Cr + Mn | " | 0.5 | 540 | O | O | O | 15,000 |
| ◎ 13 | Cr + Mn | " | 1.0 | 700 | O | O | O | " |
| 14 | Sn | Sn:1.4 | — | — | XXX | XXX | O | " |
| ◎ 15 | Sn + Mn | " | 0.5 | 420 | O | O | O | " |
| ◎ 16 | Sn + Mn | " | 1.0 | 480 | O | O | O | " |
| 17 | Pb—Sn | Pb—Sn:4 | — | — | XX | XXX | O | " |
| ◎ 18 | Pb—Sn + Mn | " | 0.5 | 550 | O | O | O | " |
| ◎ 19 | Pb—Sn + Mn | " | 1.0 | 720 | O | O | O | " |
| 20 | Al | Al:10 | — | — | XXX | XXX | Δ | 3,000 |
| ◎ 21 | Al + Mn | " | 0.5 | 560 | O | O | Δ | 7,000 |
| ◎ 22 | Al + Mn | " | 1.0 | 640 | O | O | Δ | " |

TABLE 4

| | Composition of composite coating | | Salt spray test 1,000 hrs. |
|---|---|---|---|
| A | 1.0μ Mn coating 600Å hydrated manganese oxide | + Paint coating 0.05μ | Slight red rust |
| ◎ B | " | 0.1μ | No rust |
| ◎ C | " | 0.5μ | " |
| ◎ D | " | 1.0μ | " |
| ◎ E | " | 3.0μ | " |
| ◎ F | " | 5.0μ | " |
| ◎ G | " | 10μ | " |
| ◎ H | " | 15μ | " |

TABLE 4-continued

| | Composition of composite coating | | Salt spray test 1,000 hrs. |
|---|---|---|---|
| ◎ I | " | 20μ | " |
| ◎ J | " | 30μ | " |
| K | Colored galvanized sheet (2 coats, 1 bake) | | Swelling beneath the paint coating |
| L | Colored galvanized sheet (2 coats, 2 bakes) | | Swelling beneath the paint coating |
| M | Colored galvanized sheet (3 coats, 3 bakes) | | No swelling |
| N | Colored galvanized sheet (3 coats, 3 bakes) | | " |

TABLE 5

| | | No. | Test Pieces | Features | Result of salt spray tests: 500 hrs. | 1000 hrs. | 2000 hrs. | 5 years exposure test to marine environment (Higashihama, Hirohata, Japan) |
|---|---|---|---|---|---|---|---|---|
| Without Organic Coating | Comparative Materials | 1 | Structural steel | Si—Mn steel of 50 Kg/mm² grade | | XXX | XXX | XX |
| | | 2 | Mariner steel | 0.1P-O.5Ni-0.5Cu | | XXX | XXX | XX |
| | | 3 | Mariner steel (Low-carbon Cu—P—Mo steel) | 0.1P-0.3Cu-0.2Mo | | XXX | XXX | XX |
| | | 4 | Zinc-coated steel | Zn 70μ | X | XX | XXX | XX |
| | | 5 | Al-coated steel | Al | O | O | X | X |
| | | 6 | Mn-coated steel | Mn coating 0.5μ hydrated manganese oxide 350Å | Δ | X | XX | X |
| | | 7 | " | Mn coating 1μ hydrated manganese oxide 450Å | O | Δ | X | Δ |
| | Present | 8 | Mn coated steel | Mn coating 3μ hydrated manganese oxide 400Å | ◎ | ◎ | Δ | O |

TABLE 5-continued

| | | No. | Test Pieces | Features | Result of salt spray tests 500 hrs. | 1000 hrs. | 2000 hrs. | 5 years exposure test to marine environment (Higashihama, Hirohata, Japan) |
|---|---|---|---|---|---|---|---|---|
| | in-ven-tion | 9 | " | Mn coating 4μ hydrated manganese 600 | ◎ | ◎ | ◎ | ◎ |
| | | 10 | " | Mn coating 6μ hydrated manganese 500 | ◎ | ◎ | ◎ | ◎ |
| | | 11 | " | Mn coating 8μ hydrated manganese 700 | ◎ | ◎ | ◎ | ◎ |
| | | 12 | " | Mn coating 10μ hydrated manganese 900 | ◎ | ◎ | ◎ | ◎ |
| With Or-ganic Coat-ing | Com-para-tive Mater-ials | 13 | Structural steel with organic coating | Zn-rich paint 75μ + epoxy paint 300μ | ◎ | O | X | X |
| | | 14 | Structural steel with organic coating | Zn-rich paint 75μ + tar-epoxy paint 900μ | ◎ | O | X | X |
| | | 15 | Structural steel with organic coating | Zn-rich paint 75μ + urethane paint 200μ | ◎ | O | X | O |
| | | 16 | Structural steel with organic coating | Zn-rich paint 75μ + vinyl paint 300μ | ◎ | O | X | Δ |
| | | 17 | Structural steel with organic coating | Zn-rich paint 75μ + phenol paint 300μ | ◎ | O | X | Δ |
| | | 18 | Structural steel with organic coating | Polyvinyl butyral paint (base and over coatings) 50μ | ◎ | O | X | O |
| | Pre-sent in-ven-tion | 19 | Structural steel with Mn coating and organic coating | Zn-rich paint 75μ + epoxy paint 300μ | ◎ | ◎ | ◎ | ◎ |
| | | 20 | Structural steel with Mn coating and organic coating | Zn-rich paint 75μ + tar-epoxy paint 900μ | ◎ | ◎ | ◎ | ◎ |
| | | 21 | Structural steel with Mn coating and organic coating | Zn-rich paint 75μ + urethane paint 200μ | ◎ | ◎ | ◎ | ◎ |
| | | 22 | Structural steel with Mn coating and organic coating | Zn-rich paint 75μ + vinyl paint 300μ | ◎ | ◎ | ◎ | ◎ |
| | | 23 | Structural steel with Mn coating and organic coating | Zn-rich paint 75μ + phenol paint 300μ | ◎ | ◎ | ◎ | ◎ |
| | | 24 | Structural steel with Mn coating and organic coating | Polyvinyl butyral paint (base and over coatings) 50μ | ◎ | ◎ | ◎ | ◎ |

Remarks:
◎: very good
O: good
Δ: slight rust formation
X: less than 10% red rust
XX: less than 30% red rust
XXX: less than 60% red rust

TABLE 6

Comparative Corrosion Resistance Test (JIS-Z-2371)

| | | Test Piece | Thickness of coatings | Thickness of Mn coating | Thickness of hydrated manganese oxide | Organic coating | Salt Spray Test 50 hrs. | 100 hrs. | 250 hrs. | 500 hrs. |
|---|---|---|---|---|---|---|---|---|---|---|
| | A | Cold rolled steel sheet | — | — | — | — | XX | XXX | XXX | XXX |
| | B | Galvanized steel sheet | Zn 3μ | — | — | — | XX | XXX | XXX | XXX |
| | C | " | Zn 4μ | — | — | — | XX | XXX | XXX XXX | |
| | D | Hot dipped Zn-coated steel sheet | Zn 14μ | — | — | — | O | O | XX | XXX |
| | E | Hot dipped Zn-coated steel sheet | Zn 20μ | — | — | — | O | O | XX | XXX |
| | F | Zn—Fe alloy coated steel sheet | Zn—Fe 8μ | — | — | — | O | O | X | XX |
| ◎ | G | Mn coated steel sheet | — | 0.2μ | 0.05μ | — | O | O | Δ | X |
| ◎ | H | " | — | 0.4μ | 0.07μ | — | O | O | O | X |
| ◎ | I | " | — | 0.6μ | 0.04μ | — | O | O | O | Δ |
| ◎ | J | " | — | 1.0μ | 0.09μ | — | O | O | O | Δ |
| | K | Cold rolled steel sheet with organic coating | — | | | Epoxy + silicon polyester 25μ | O | X | XX | XXX |
| | L | Hot dipped Zn-coating and organic coating | Zn 20μ | — | — | Phosphate treatment 1.8g/m$^2$ epoxy + silicon polyester 25μ 1.8g/m$^2$ | O | O | O | O |

TABLE 6-continued

| | Test Piece | Comparative Corrosion Resistance Test (JIS-Z-2371) Thickness of coatings | Thickness of Mn coating | Thickness of hydrated manganese oxide | Organic coating | Salt Spray Test 50 hrs. | 100 hrs. | 250 hrs. | 500 hrs. |
|---|---|---|---|---|---|---|---|---|---|
| M | Phosphate treatment and organic coating | — | — | — | epoxy + silicon polyester 25μ | O | O | O | XX |

Remarks:
O: good
Δ: less than 10% rust
X: less than 30% rust
XX: less than 60% rust
XXX: rust formation over the whole surface

What is claimed is:

1. A coated steel material having excellent corrosion resistance, comprising a manganese coating and hydrated $MN.MNO_3$ of thickness 400 to 1000 Å formed on the manganese coating.

2. A coated steel material according to claim 1, in which the manganese coating is in a thickness ranging from 0.5 to 10μ, and the hydrated manganese oxide is in a film ranging from 400 to 1000 Å.

3. A coated steel material according to claim 1, in which the manganese coating is in a thickness ranging from 2.8 to 11μ and the hydrated manganese oxide is in a film ranging from 400 to 1000 Å, and which is useful for marine structures.

4. A coated steel material according to claim 3, which further comprises a zinc-rich paint coating in a thickness ranging from 50 to 100μ and a paint coating of the one selected from the group consisting of epoxy, tar-epoxy, urethane, vinyl and phenol paints in a thickness ranging from 200 to 900μ applied on the zinc-rich paint coating.

5. A coated steel material according to claim 4, which further comprises a rust stabilizing paint coating composed mainly of polyvinyl butyral in a thickness ranging from 20 to 60μ.

6. A coated steel material according to claim 1, in which a cold rolled steel sheet of 50 to 150μ thick is coated with the manganese coating in a thickness ranging from 0.2 to 1μ and the hydrated manganese oxide is in a film ranging from 400 to 1000 Å thick, and which is very useful for cultivating young plants.

* * * * *